United States Patent [19]

Thuruta et al.

[11] Patent Number: 4,779,430

[45] Date of Patent: Oct. 25, 1988

[54] FULLY-AUTOMATED WASHER

[75] Inventors: Sizuo Thuruta, Kitaibaraki; Yoshiaki Takeda, Hitachi; Isao Hiyama, Hitachi; Kenichi Kubo, Hitachi; Toshikazu Ohonishi, Hitachi; Hideyuki Tobita, Hitachi; Tamotu Shikamori, Ibaraki; Hiroshi Ohsugi, Hitachi, all of Japan

[73] Assignee: Hitachi, Ltd., Tokyo, Japan

[21] Appl. No.: 789,033

[22] Filed: Oct. 18, 1985

[30] Foreign Application Priority Data

| | | | |
|---|---|---|---|
| Oct. 19, 1984 | [JP] | Japan | 59-218420 |
| Oct. 19, 1984 | [JP] | Japan | 59-218421 |
| Oct. 24, 1984 | [JP] | Japan | 59-222137 |
| Jan. 23, 1985 | [JP] | Japan | 60-9074 |
| Jan. 23, 1985 | [JP] | Japan | 60-9075 |
| Jan. 29, 1985 | [JP] | Japan | 60-14780 |
| Jan. 29, 1985 | [JP] | Japan | 60-14781 |
| Jan. 29, 1985 | [JP] | Japan | 60-14784 |
| Jul. 25, 1985 | [JP] | Japan | 60-164733 |

[51] Int. Cl.[4] ..... D06F 33/02

[52] U.S. Cl. ..... 68/12 R; 68/13 R; 68/207; 68/17 R

[58] Field of Search ..... 68/12 R, 17 R, 13 R, 68/207

[56] References Cited

U.S. PATENT DOCUMENTS

| | | | |
|---|---|---|---|
| 2,698,022 | 12/1954 | Fahnoe | 68/17 R X |
| 3,094,247 | 6/1963 | Marcni | 68/17 R X |
| 3,160,317 | 12/1964 | Hambro | 68/17 R |
| 3,336,767 | 8/1967 | Mackenzie et al. | 68/17 R X |
| 3,881,328 | 5/1975 | Kleimola et al. | 68/12 R |
| 3,935,719 | 2/1976 | Henderson | 68/207 X |
| 4,103,520 | 8/1978 | Jarvis et al. | 68/207 X |
| 4,400,838 | 8/1983 | Steers et al. | 68/12 R X |
| 4,450,696 | 5/1984 | Zukausky | 68/207 X |
| 4,607,408 | 8/1986 | Didier et al. | 68/12 R |

FOREIGN PATENT DOCUMENTS

| | | | |
|---|---|---|---|
| 3141792 | 5/1983 | Fed. Rep. of Germany | 68/12 R |
| 53-35272 | 4/1978 | Japan | 68/12 R |
| 59-37989 | 3/1984 | Japan | 68/12 R |
| 2087438 | 5/1982 | United Kingdom | 68/12 R |

*Primary Examiner*—Harvey C. Hornsby
*Assistant Examiner*—Frankie L. Stinson
*Attorney, Agent, or Firm*—Antonelli, Terry & Wands

[57] ABSTRACT

In a fully-automated washer, a cloth amount sensor detects a quantity of an object being washed as a value inclusive of information regarding a degree of bulkiness of the object to be washed. A processing circuit is responsive to a detection output signal from the cloth amount sensor to determine a water supply amount, a cleanser feed amount, a stirring or agitating time and a rinsing time. The cloth amount sensor is mounted to a stirring or agitating motor. Upon an OFF-state of the motor, the detection output signal is generated by measuring a voltage waveform induced by inertial motion which varies in accordance the degree of bulkiness of the object to be washed.

26 Claims, 10 Drawing Sheets

| AUTOMATIC FEED AMOUNTS OF CLEANSER (INDEX) | | | | |
|---|---|---|---|---|
| SELECTED KEY \ CLOTH AMOUNT (WATER LEVEL) | RATED (HIGH) | MEDIUM (MEDIUM) | SMALL (SMALL) | VERY SMALL (VERY SMALL) |
| A HEAVILY SOILED | 12 | 10 | 8 | 6 |
| B STANDARD | 10 | 8 | 6 | 4 |
| C LIGHTLY SOILED | 5 | 4 | 3 | 2 |

| CLOTH AMOUNT OF THE OBTECT | DAMPING TIME Th |
|---|---|
| VERY SMALL | 0.2 < 0.3 |
| SMALL | 0.16 < 0.2 |
| MEDIUM | 0.1 < 0.16 |
| RATED | 0.1> |

FIG. 18
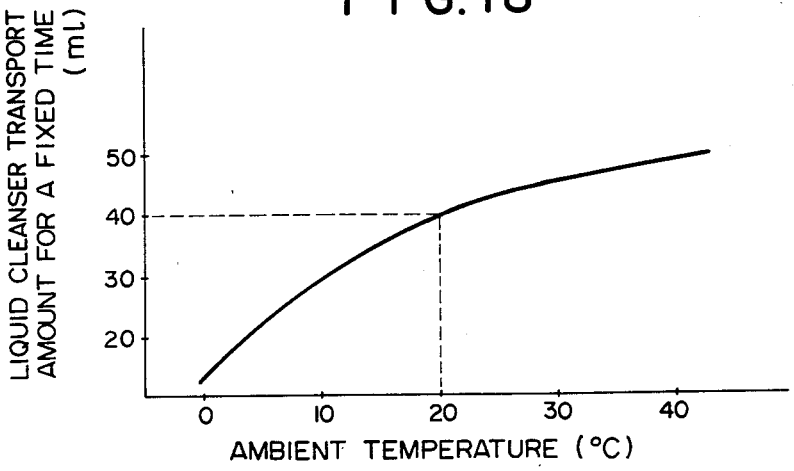
FIG. 19
| SEGMENTAL AMBIENT TEMP. RANGE | T1 | T2 | T3 | T4 | T5 | T6 | T7 | T8 | Tn |
|---|---|---|---|---|---|---|---|---|---|
| DRIVE TIME | a | b | c | d | e | f | g | h | x |
FIG. 20
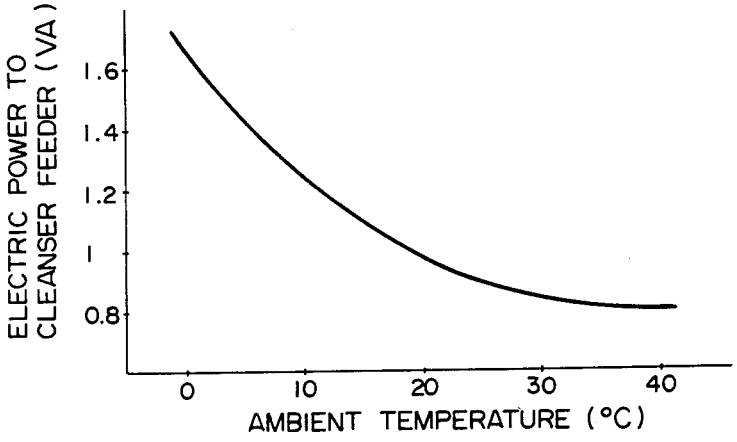

FULLY-AUTOMATED WASHER

BACKGROUND OF THE INVENTION

This invention generally relates to washing machines and, more particularly, to improvements in a fully automated washer which automatically performs operational processes ranging from water-supply before washing to dehydration after washing.

In automated washers, it is necessary for a sensor to accurately detect information regarding a quantity of an object to be washed which is thrown into a washing drum because a stirring or agitating time, a feed amount of cleanser, a water-supply amount for rinsing and a rinse time are determined for the object to be washed independence upon the information regarding the quantity of the object. Without accurate regulation of the water-supply amount and cleanser feed amount, an optimum washing operation can not be performed formed automatically.

For example, Japanese patent unexamined publication No. 53-35272, proposes a fully automated washer; however this proposal only provides weights of an object being washed as information regarding quantities of the object. It has been found that, in automated washers, detecting only a weight of an object to be washed as information regarding a quantity of the object fails to determine optimum water-supply and cleanser feed amounts. The aforementioned proposal teaches detection of degrees of soil and determination of cleanser feed amounts but fails to disclose any specific means and method for the purposes. However, unless, in fully automated washers, the construction of an expedient operative to regulate the water-supply and cleanser feed amounts and a control method therefor are deliberatively contrived for accurate adjustment of these amounts, an optimum automatic washing operation can not be expected.

SUMMARY OF THE INVENTION

An object of this invention is to provide a fully automated washer capable of performing optimum washing operations by correctly detecting a status of an object to be washed which is thrown into a washing drum and by accurately regulating the water-supply and cleanser feed amounts.

This invention is most featured in that a degree of bulkiness of an object to be washed which differs with the kind of fabric material of the object is detected as information regarding a quantity of the object thrown into the washing drum by means of a sensor. In the following description, the quantity of the object to be washed inclusive of the degree of bulkiness of the object will be simply called "a cloth amount".

BRIEF DESCRIPTION OF THE DRAWINGS

The present invention will be apparent from the following detailed description taken in conjunction with the accompanying drawings, in which:

FIG. 18 is a graph showing a change in transport amount of a liquid cleanser dependent upon a change in viscosity of the liquid cleanser per se, plotted in relation to ambient temperatures;

FIG. 19 shows the relationship between the ambient temperature and the operating time of a motor pump used for cleanser transport;

FIG. 20 is a graph illustration of the relationship between the ambient temperature and the electric power supplied to the motor pump for cleanser transport;

DESCRIPTION OF THE PREFERRED EMBODIMENTS

Figure 1:
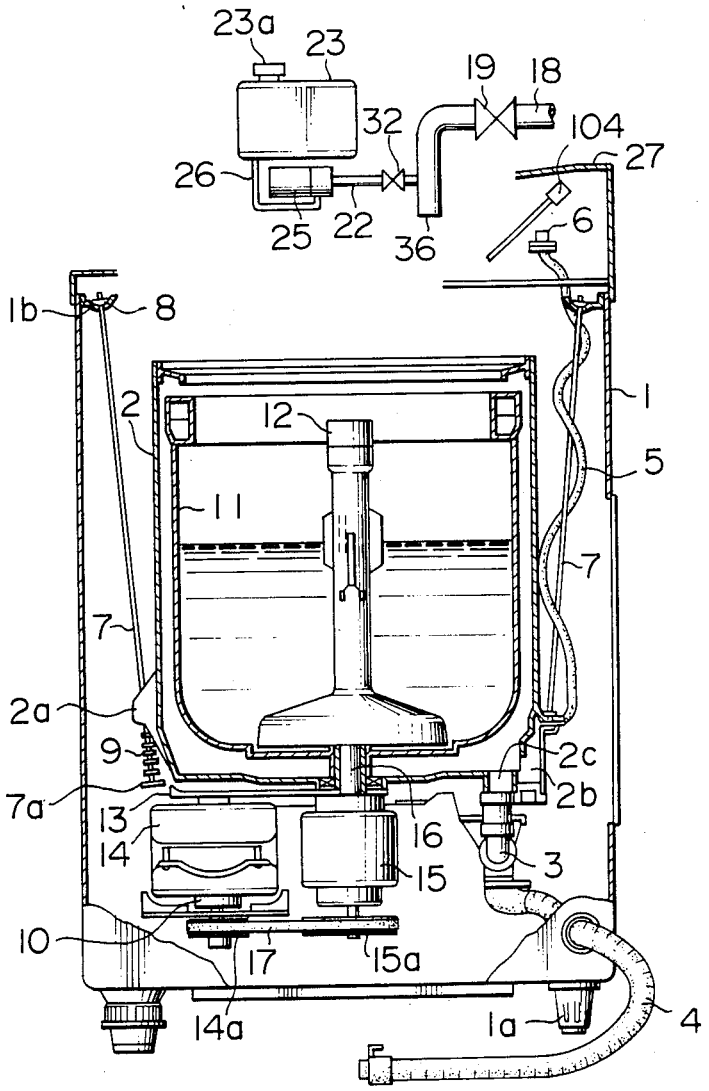
FIG. 1 is a schematic diagram for explaining the overall construction of an automated washer according to an embodiment of the invention.

The invention will now be described by way of example with reference to the accompanying drawings. Referring to FIG. 1, an outer tank 2, adapted to accommodate water for washing is arranged in an outer casing 1, with the outer tank 2 having a support lug 2*a* which projects outwardly, and suspension rod 7 engages the support lug 2*a* through a spring 9. The suspension rod 7 is connected, at its opposite ends, to a lower seat 7*a* and an upper seat 8 which is secured to a corner plate 1*b* fixed to an upper portion of the outer casing 1, so that the outer tank 2 is resiliently supported. A washing drum 11 has perforations formed in its peripheral wall and also serves as a dehydration drum. A stirring or agitating blade 12 for stirring or agitating an object to be washed is connected to a shaft 16 coupled to a driver 15. The driver 15 includes a reduction mechanism and a clutch part so as to sort the rotation of the stirring blade 12 and that of the washing drum 11. Pulleys 14*a* and 15*a* transmit torque from a drive motor 14 to the driver 15 through a belt 17. A center base 13 for supporting the motor 14 and driver 15 is supported at the bottom of the outer tank 2. An intake port 2*b* projects from a lower portion of the outer tank 2 and communicates, through a tube 5, with a water level sensor 6 which checks an amount of supplied water in terms of a water level. A drainage hole 2*c* is connected to a drain valve 3 which, in turn, is connected to a drainage hose 1 extending exteriorly of the outer casing 4. The outer casing 1 has at a bottom thereof legs 1*a*. A cloth amount sensor 10 is operable to detect rotation of the motor 14.

A water supply pipe 18 extending from a water service faucet (not shown) supplies water into the washing drum 11 through a water supply valve 19. A top cover, 27 is provided, with a temperature sensor 104 for ambient temperature detection being disposed beneath the top cover 27.

A storage tank 23 for a liquid cleanser has a lid 23*a*. A motor pump 25 for forcibly transporting the liquid cleanser is connected to a suction tube 26 connected by the tank 23 and to a discharge tube 22. The discharge tube 22 connects, through a check valve 32, to a connector 24 (FIG. 4) which relays to the water supply portion for supplying water to the washing drum 11.

Figure 2:
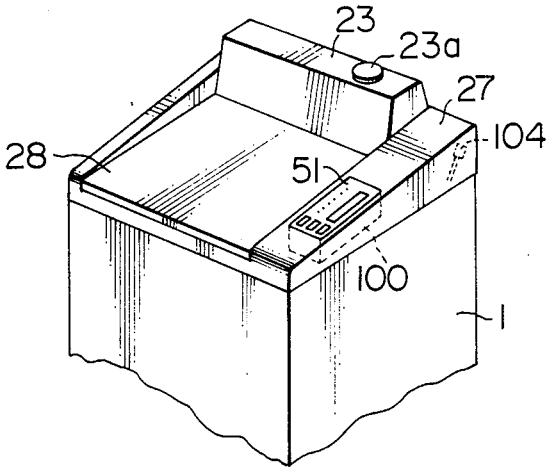
FIG. 2 is a perspective view, as seen from above, of the automated washer shown in FIG. 1.
Figure 3:
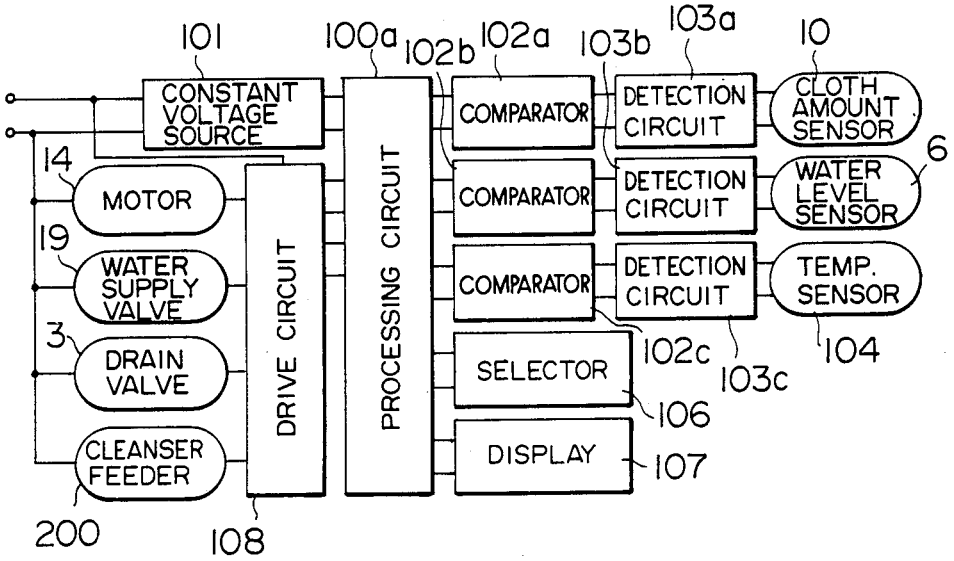
FIG. 3 is a block diagram schematically showing an example of an electric circuit of the automated washer shown in FIG. 1.

Referring to FIG. 2, an operation panel 51 for a user is disposed on the top cover 27. In this embodiment, the storage tank 23 for the liquid cleanser is removably mounted on the top of the washer, and a portion 100 of an electrical control circuit as shown in FIG. 3 is disposed beneath the operation panel 51. A lid 28 covers an opening through which an object to be washed is thrown in. as shown in FIG. 3, the electrical control circuit has, in the center thereof, a processing circuit 100*a* comprised of a microcomputer which is supplied with a constant DC voltage from a constant voltage source circuit 101. The processing circuit 100*a* is coupled to the cloth amount sensor 10 through comparator circuit 102*a* and detection circuit 103*a*, to the water level sensor 6 through comparator circuit 102*b* and detection circuit 103*b*, and to the temperature sensor 104 through comparator circuit 102*c* and detection circuit 103*c*. A selection circuit 106 is used for selecting washing processes, and a display circuit 107 is operative to display a selected process, a cleanser amount and various abnormal conditions. Signals from the various sensors are processed by the microcomputer and supplied, through a drive circuit 108, to desired one or ones of motor 14, water supply valve 19, drain valve 3 and cleanser feeder 200.

Details of the cleanser feeder 200 will be described with reference to FIGS. 4 and 5. Between a water level of liquid cleanser 33 contained in the tank 23 and the check valve 32 constituting a discharge port 32*a*, there is a fall H. In some instances, the water level of the liquid cleanser may be below the discharge port 32*a* and the fall H may become negative. In this embodiment, the tank 23 is disposed on the top cover 27 of the washer so that the fall H is positive but if the tank 23 is otherwise disposed within an internal room space of the outer casing 1, the fall H will become negative. Without the check valve 32, the liquid cleanser will spontaneously flow out when the fall H is positive whereas the liquid cleanser present in the tube 22 will return to the motor pump 25 when the fall is negative, thus giving rise to irregularity in the cleanser feed amount which is scheduled to be determined by the driving time for the motor pump 25. As shown in FIG. 5, the check valve 32 has the discharge port 32*a*, a charge port 32*b* and an intervening central portion in which a rubber plate 38, a spacer 39 and a weak spring 40 are so arranged that the liquid cleanser is allowed to pass unidirectionally. The discharge port 32*a* is disposed downstream of a water path in which water is passed through water supply valve 19, water supply hose 18*a*, connecting port 24*a* and flow-smoothing pin array 24*b*. This disposition of discharge port 32*a* can ensure that the cleanser can be mixed with water so as to be diluted and fed into the washing drum through a water discharge hole 24*c*, thereby preventing an object to be washed from being deteriorated by a condensed or highly concentrated cleanser.

Figure 6:
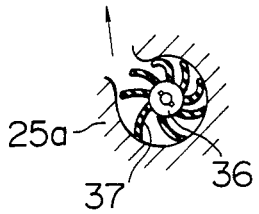
FIG. 6 is a sectional view showing the operation of a cleanser feed motor pump shown in FIG. 4.
Figure 7:
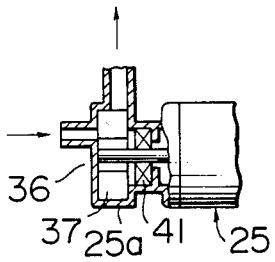
FIG. 7 is a partly sectional view of a motor pump shown in FIG. 6.

As shown in FIGS. 6 and 7, the motor pump 25 is exemplified in this embodiment as a small electric motor which has, in its casing 25*a*, blades 37 connected to a motor shaft 36, and a seal member 41. Under rotation of the blades 37, the liquid cleanser is forcibly transported in a direction of arrow.

These blades 37 of the pump 25 are made of rubber or flexible plastics and outer peripheral ends of the blades are resiliently pressed against the inner periphery of the casing 25*a*, thereby constituting a so-called vane type pump.

Since this pump can transport air along with the cleanser, air lock never occurs even when air prevails in the tube 22. It is thus preferable for the present invention that the pump with ability to discharge air be used for transport of the liquid cleanser.

This pump 25 tends to be worn by friction under a racing of the blades 37. However, the pump 25 will not be damaged since, under normal operations, it will not be operated for a long time. It is recommended that silicon oil be applied to sliding portions of the blades 37 to keep a long lifetime of the pump. For accurate control of the amounts of cleanser to be transported, a stepping motor may preferably be used as the small electric motor. Since the blades 37 make close contact to the casing 25*a*, the pump 25, different from the other types of pump, also acts as a flow path valve when it stops operating, to aid the check valve 32.

This pump 25 deals with a small flow rate but can, efficiently produce a sufficient pressure. The liquid cleanser has different amounts of viscosity dependent upon its kind. If the pump can not produce the sufficient pressure, the transport amounts will greatly be decreased when the viscosity becomes slightly higher. With this pump 25 capable of producing the sufficient pressure, a decrease in the transport amount can be suppressed. Advantageously, even when various kinds of cleanser are used, the cleanser feed amounts will not therefore differ to a great extent.

As described previously, the discharge port (tip end) 32*a* of the check valve 32 is in communication with the water discharge hole 24*c* through the connector 24. This construction is employed for the following reasons.

The check valve 32 is provided at the tip end of the tube 22 in order to minimize drip amounts of the residual cleanser after the cleanser feed stops.

Since the drip of the residual cleanser taking place after a termination of a washing unduly requires repetitive rinses, the drip-proof measure is important.

Even if the check valve 32 is highly efficient, a small amount of cleanser will be left at the discharge port, leading to adverse drip or gelation (thereby blocking of the discharge hole) of the cleanser. However, in the FIG. 4 embodiment, the discharge port 32*a* lies in the connector to face the water discharge hole 24*c* and hence the discharge port 32*a* can be clenned considerably during water-supply operations inclusive of rinsing to eliminate the aforementioned inconveniences.

Figure 4:
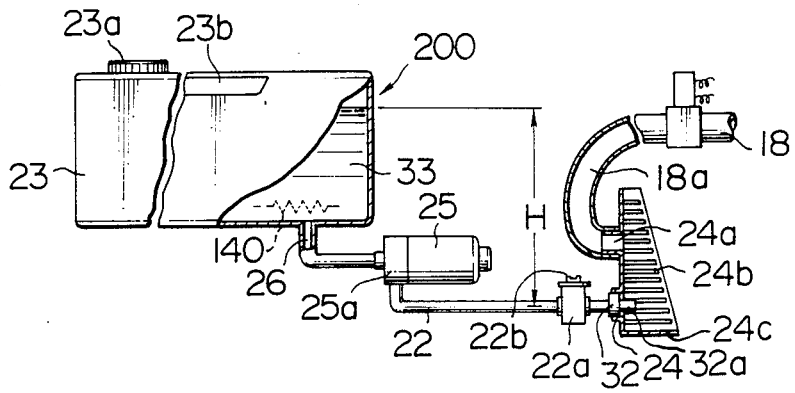
FIG. 4 is a diagram for explaining the operation of a cleaner feeder shown in FIG. 1.
Figure 5:
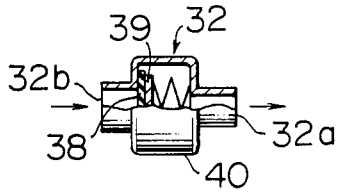
FIG. 5 is a partly sectional view of a check valve shown in FIG. 4.

As shown in FIG. 4, a regulator 22*a* having a regulating valve 22*b*, serving as a cleanser feed amount adjusting means, is disposed intermediate the tube 22.

Figures 8, 9:
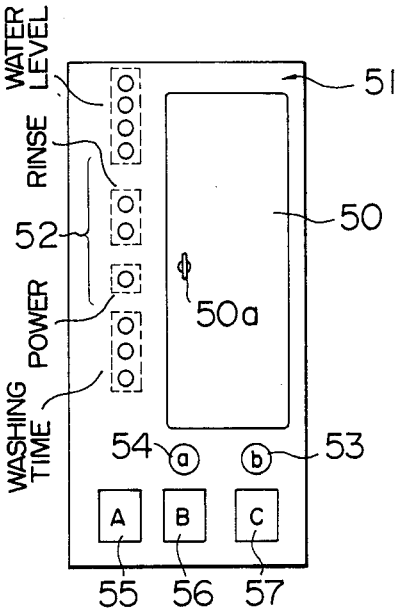
FIG. 8 is a front view of an operation panel shown in FIG. 2.
FIG. 9 shows the relation between selection keys shown in FIG. 8 and cleanser feed amounts.

The automated washer of the above construction is manipulated and operated as will be described with reference to FIGS. 8 to 10. The operation panel 51 has a display portion 52. The user selects one of large-sized main operation keys 55, 56 and 57 provided at a convenient position for a user to determine one of "heavily soiled", "standard" and "lightly soiled" modes. By keying in a selected key, a washing operation is started in accordance with a predetermined washing process program. Before or after the main operation key 55, 56 or 57 is keyed in, auxiliary keys 53 and 54 may be keyed in to perform pre-washing operations of "preparatory washing" and "soakage washing", respectively. These pre-washing operations are pregrammed in the above predetermined washing process program. Accordingly, after the pre-washing operations end, the operational procedure jumps to a program corresponding to either keyed-in main operation key 55, 56 or 57 so as to perform a washing process operation. A plain lid 50 is provided with a knob 50*a*. Disposed beneath the lid 50 are various switches which are used for a desired alternation of the program determined by either keyed-in main operation key 55, 56 or 57. For example, a manual key for changing the washing time or the dehydration time is provided. To avoid troublesome selection of various keys, only keys primarily used for washing operations are provided on the operation panel and keys to be used infrequently are covered with the plain lid 50. As far as the automated washer is operated for normal automatic washing, the switches covered with the plain lid 50 need not be actuated.

The cleanser is fed by keying in either main operation key 55, 56 or 57 and the cleanser feed amounts are finely adjusted in accordance with modes of the main operation keys and cloth amounts of objects to be washed. For example, the main operation key 55 for a mode A is pushed for washing a heavily soiled object. When an automatic operation is started by keying in the key 55, the cleanser feed amount is increased by about 20% with respect to that for a mode B representative of "standard". When the key 57 for a mode C is pushed for washing a lightly soiled object, the cleanser feed amount becomes approximately half the amount for the mode B.

Figure 10:
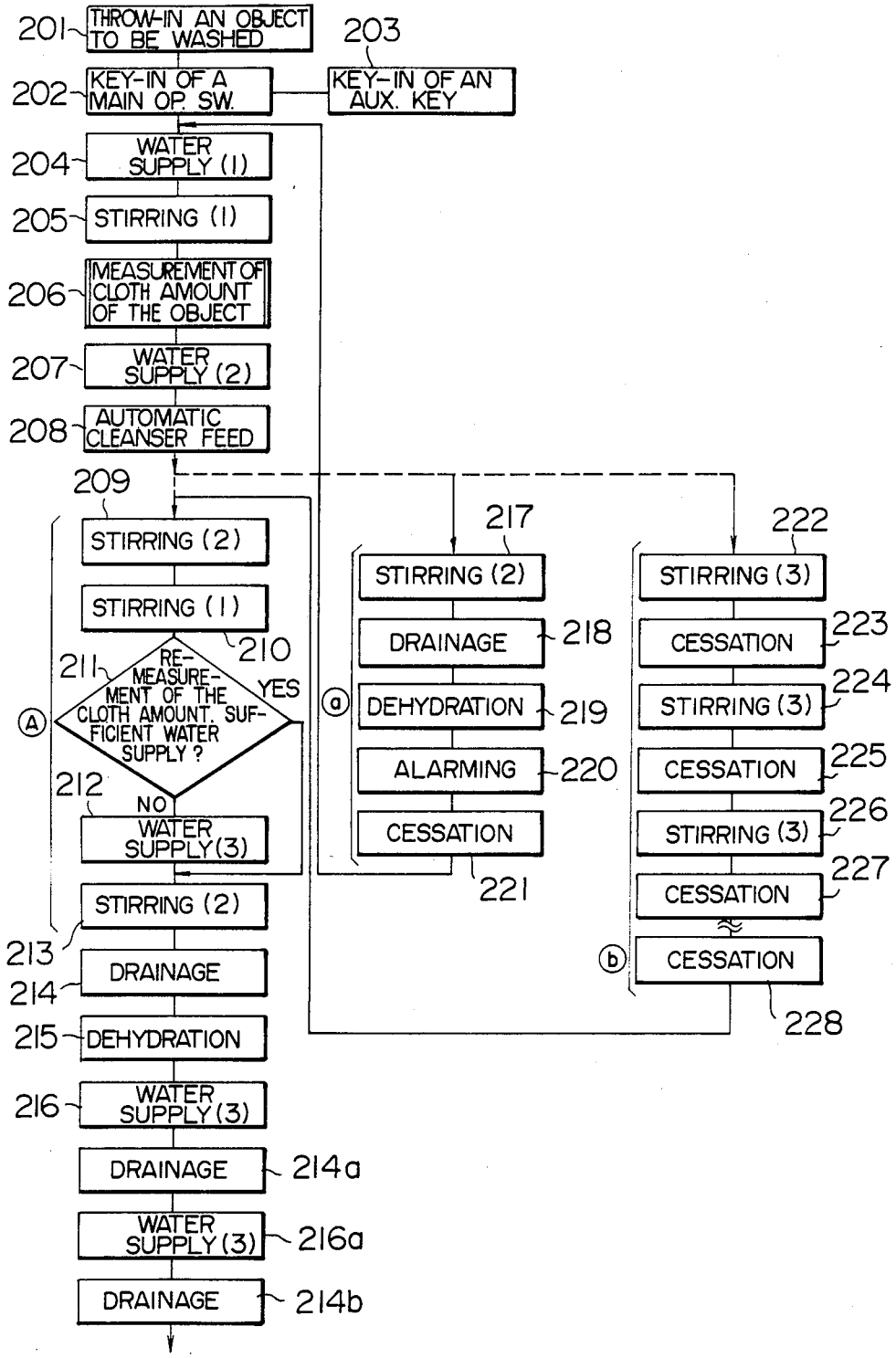
FIG. 10 is a simplified flow chart showing an example of a washing process.

The washing process operations are carried out in accordance with a simplified flow chart of FIG. 10. In step 201, an object to be washed is first thrown in, and either main operation key 55, 56 or 57 is keyed in pursuant to a degree of soil of the object in step 202. Water supply (1) is then performed in step 204. The water supply (1) continues until a water-supply amount to the washing drum, detected by the water level sensor 6 in terms of a water level, reaches a "very small" level of four preset grading levels "very small", "small", "medium" and "high". Subsequently, stirring or agitating (1) is performed in step 205. The stirring or agitating (1) is very weak as compared to stirring or agitating for normal washing and used to measure a cloth amount of the object being washed in step 206. A measured cloth amount determines a water level of water supply (2) of step 207 and a cleanser feed amount of step 208. Thus, the water supply (2) and automatic cleanser feed are carried out correspondingly. Since the cloth amount of the object being washed and the cleanser feed amount are now known, a water-supply amount and a time for rinsing as well as a dehydration time can also be determined in this phase. As a result, parameters necessary for subsequent steps can be determined to complete a program for the ensuring steps.

After the water level and the cleanser feed amount have been set to meet the cloth amount of the object in water-supply (2) of step 207 and in cleanser feed of step 208, the washing process sequentially proceeds to stirring or agitating (2) adapted for washing the object in step 209, drainage in step 214, dehydration in step 215, water supply (3) for a first rinsing in step 216, drainage for the first rinsing in step 214*a*, and water supply (3) for a second rinsing in step 216*a*, and ends at drainage for the second rinsing in step 214*b*. The water-supply amount for the first rinsing may be one grade greater, in terms of the water level, than the water-supply amount set for stirring or agitating and washing (step 209) in accordance with the cloth amount, provided that it does not exceed a maximum water level for the washing drum. The water-supply amount for the second rinsing may be set to the maximum level. By so setting the water-supply amounts for the first and second rinsing operations, the effect of rinsing can further be promoted. In some instances, steps 210 to 213 as bracketed by Ⓐ may be added.

Actually, the cleanser is automatically fed during the water supply (2) so as to be mixed with water being supplied. To this end, the cleanser feeder 200 is operated together with actuation of the water supply valve 19.

In addition to the key-in steps by the main operation key, the auxiliary key 53 or 54 may be keyed in in step 203 to automatically perform a pre-washing operation, which has conventionally been performed manually, in accordance with an additional program. A "preparatory washing" process operation started by keying in the auxiliary key 53 for a mode ⓐ is performed before the normal washing in order to pre-wash a very soiled object such as overalls or diapers. In general, after completion of the "preparatory washing", another object to be washed is added to the preliminarily washed object and thereafter the washing procedure proceeds to the subsequent steps. Therefore, an amount of cleanser meeting a cloth amount of the object subject to the "preparatory washing" is automatically fed in step 208, and then step 217 for stirring (2), step 218 for drainage, step 219 for dehydration followed by a cessation, step 220 for alarming and step 221 for a cessation as bracketed by ⓐ proceed. Completion of the "preparatory washing" is informed through the alarming and cessation steps and supply of the additional object is instructed. When a predetermined time for cessation is over, the subroutine of "preparatory washing" may be left intact for waiting until the supply of the additional object is decided by detecting a signal representative of open/closure of the lid effected when supplying the additional object and thereafter may proceed to the subsequent step. Alternatively, the subroutine may immediately proceed to the subsequent step when the predetermined time for cessation is over. The subsequent step herein means the step 204 for water supply (1) in which water is supplied by keying in a main operation key 55, 56 or 57 until the "very small" level. In this phase, a cloth amount of the resultant object is measured and an amount of cleanser is again fed automatically. Thereafter, the steps of stirring or agitating for washing (2), drainage, dehydration and water supply (3) for rinsing proceed sequentially.

A "soakage washing" process is started by keying in the auxiliary key 54 and performed through steps bracketed by ⓑ as shown in FIG. 10. Conventionally, a "soakage washing" operation is manually effected for pre-washing a very heavily soiled object prior to washing of the object within a washer by soaking the soiled object in a washtub supplied with water added with a cleanser, by rubbing the object at intervals of time to impart a vibratory motion to the same and by again soaking the object in the washtub for a suitable time. Thereafter, the object is moved to a washing drum 11 supplied with water added with the cleanser and washed in accordance with a normal program. All of the above pre-washing operations of "soakage washing" are carried out by the washer by itself according to the embodiment shown in FIG. 10. Before or after either main operation key 55, 56 or 57 for the mode A, B or C is keyed in, the auxiliary key 54 is keyed in. The washing procedure sequentially proceeds until the step 208 for automatic feed of a cleanser in accordance with the previously mentioned predetermined program and branches to steps 222 to 228 bracketed by ⓑ in which a set of stirring or agitating (3) for a short time of, for example, ten seconds to three minutes, in step 222 and a cessation for a relatively long time in step 223 is cyclically repeated several times through steps 224 to 228 to perform a "soakage washing" process operation. This process operation typically continues for about one hour.

This "soakage washing" process operation is not followed by drainage and dehydration steps. Thus, after completion of the "soakage washing", the washing procedure proceeds from the final cessation step to the step 209 for stirring (2) adapted for normal washing. In the case of the "soakage washing" process operation, it is after this pre-washing that the very soiled object to be washed initially thrown into the washing drum is subjected to the normal washing.

The time for the stirring (2) in the step 209 adapted for normal washing is not always required to be preset but it may be adjusted by keying in a particular operation key, although a complicated program for this purpose is needed. To describe such a modification, attention should first be drawn to the fact that a cancel key for cancelling the automatic cleanser feed is provided beneath the plain lid 50 and that the cancel key is keyed in with the lid 50 opened when the liquid cleanser to be fed automatically is used up and a spare powder cleanser must be used. The keying-in of the cancel key is fetched by the processing circuit 100*a* only during the stirring or agitating step for washing or after the water supply, in order to prevent clothes from being deteriorated by direct adherence of the powder cleanser thereto. It takes a longer time for the powder cleanser to dissolve in water than for the liquid cleanser. Accordingly, a soiled object will be less cleaned if subjected to the stirring or agitating (2) for washing of step 209 in the powder cleanser solution for the same time as in the liquid cleanser solution. Further, while the liquid cleanser immediately dissolves in water, a few minutes, though dependent upon water temperatures, are required for the powder cleanser to dissolve in, water. By keying in the cancel key, the time for the stirring or agitating (2) for washing of the step 209 can be prolonged to remove the difference in cleaning rate.

The "soakage washing" is so effective that the time for the stirring or agitating (2) of step 209 can be reduced by half when compared with the normal washing unaffected by the "soakage washing".

Similarly, in the case of the "preparatory washing", the additional amount of cleanser to be fed automatically can be reduced as compared to the initial automatic cleanser feed amount. Therefore, sufficiently advantageous effects can be attained and consumption of the cleanser can be reduced.

Figure 11:
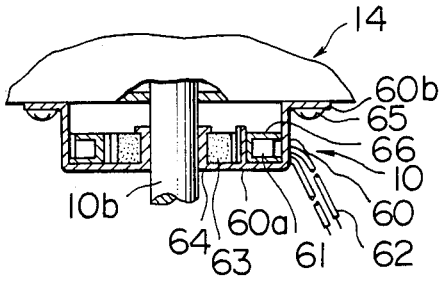
FIG. 11 is a partly sectional view of a cloth amount sensor shown in FIG. 1.

The cloth amount sensor 10 adapted to judge the cloth amount of an object being washed will now be described. Referring to FIG. 11, a sleeve 64 having a magnet 63 is press-fitted on a shaft 10*b* projecting from the motor 14. A casing 60 carrying a magnetic pole piece 60*a* and a bobbin 66 is fixed at its flange 60*b* to a casing 14*a* of the motor 14 by fasteners such as, for example, screws 65. The magnetic pole piece 60*a* opposes the magnet 63 and a coil 61 is wound on the bobbin 66. The coil 61 has lead wires 62. When stirring, or agitating, the motor 14 is intermittently energized to establish an ON state for 0.3 to 1.0 second and an OFF state for 0.3 to 2.0 seconds. This ON/OFF state is cyclically repeated to rotate the shaft 10*b*.

Figure 12:
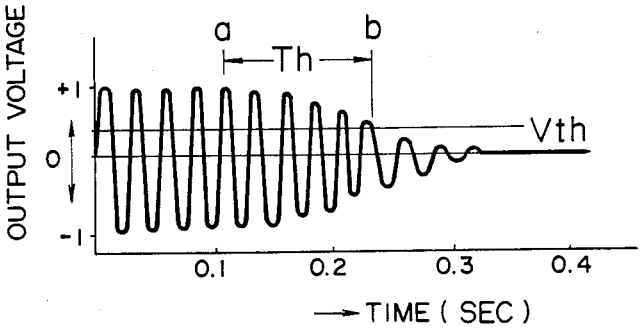
FIG. 12 is a graph showing a waveform of an output signal from the cloth amount sensor shown in FIG. 11.
Figures 13, 14:
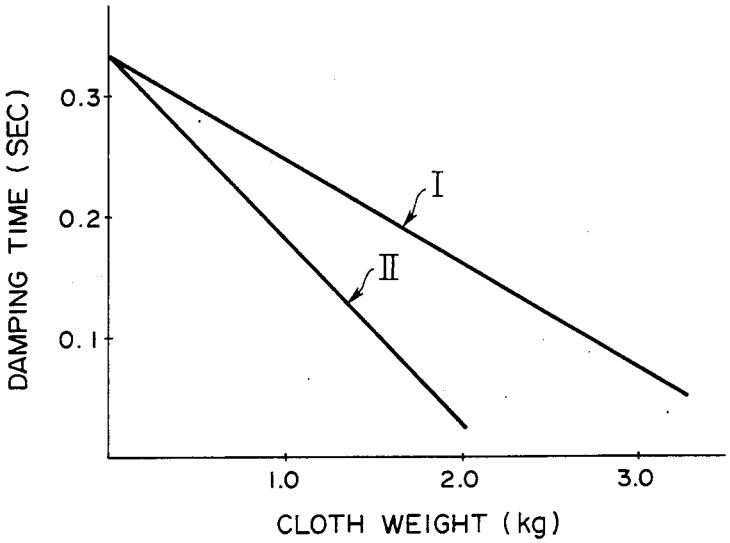
FIG. 13 is a graph illustrating a relationship between the damping time and the cloth weight of an object to be washed changes with the kind of the object.
FIG. 14 illustrates a relation between the damping time of the waveform shown in FIG. 12 and the cloth amount of the object.

In order to obtain an accurate judgement of the cloth amount, it is preferable, in judging the cloth amount by using the cloth amount sensor 10, to select the duty ratio of the motor 14 to become smaller than that at a normal washing state of the motor. Namely, an accurate judgement of the cloth amount can be carried out by shortening the ON time of the motor 14 than that at a normal washing state and/or lengthen the OFF time of the motor 14 than that at a normal washing state. The magnet 63 and the magnetic pole piece 60*a* induce an electromotive force. Because of inertia in revolutions, the shaft 10*b* continues to rotate after the OFF state of the motor 14 and consequently, the induced electromotive force takes a waveform as shown in FIG. 12. It is now assumed that the motor OFF state occurs at point a and the rotation of the shaft 10*b* is decreased to produce, until reaching point b, a voltage waveform whose peak values exceed a threshold value $V_{th}$ (for example, 0.4 volts). Then, it is possible to judge a cloth amount of an object thrown into the washing drum from a time interval or damping time $T_h$ between the points a and b. In this case, the damping time $T_h$ may be measured directly or alternatively, the number of peaks of the voltage waveform exceeding the threshold may be counted. In determining the damping time by counting the peaks, the motor may repetitiously be ON/OFF operated a plurality of times to average or sum up counts of peaks of voltage waveforms under the repetitious OFF states. The cloth amount of the object to be washed can be judged from the damping time $T_h$ for reasons as described below with reference to FIG. 13. The relationship between the cloth weight and damping time is as shown in FIG. 13 wherein a curve I is plotted for a so-called "mixture of clothes" which is a combination of various kinds of clothes and which is assumptive of a usual and practical household object to be washed, and a curve II for relatively hard and bulky clothes such as jeans. It will be seen from FIG. 13 that for the same weight, the bulky clothes provide a damping time which is shorter than that of the clothes represented by curve I and hence provide information indicative of a heavier object than an object represented by curve I. When the water-supply amount is determined by this information, the water level is set higher for the bulky clothes such as jeans than for the clothes of curve I. This result conveniently meets practical washing operations.

Accordingly, by determining a water-supply amount, a cleanser feed amount and a stirring time on the basis of a detection signal from cloth amount sensor 10 which represents a quantity inclusive of bulkiness of an object to be washed, a highly accurate washing operation can be performed.

FIG. 14 illustrates the relationship between the damping time $T_h$ and the cloth amount of an object to be washed. This relationship is obtained with the cloth amount sensor 6 shown in FIG. 11. In this example, the cloth amount is classified into four grades in accordance with damping times (or count values).

Figure 15:
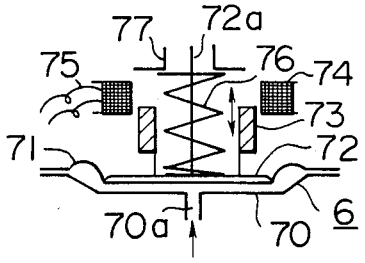
FIG. 15 is a schematic sectional view of a water level sensor shown in FIG. 1.

The water level sensor 6 as exemplified in FIG. 15 has a base 70 formed with a pressure transmission hole 70*a* through which a pressure is transmitted to a diaphragm 71. A plunger 72 overlies the diaphragm 71 and has a displacement guide and support rod 72*a* which safeguards the plunger against its oblique displacement. A magnetic member 73 is fixedly mounted to the plunger. A coil 74 has lead wires 75, with a spring 76 biases, cooperating with a spring seat 77, biasing the diaphragm 71 by desirably loading it in accordance with a pressure applied thereto.

Figure 16:
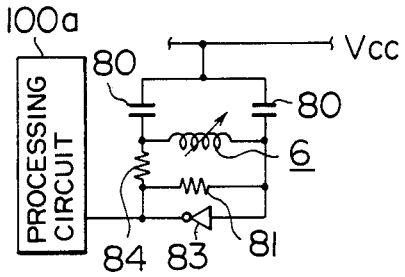
FIG. 16 is an electric circuit diagram for generating an output signal from the water level sensor shown in FIG. 15.
Figure 17:
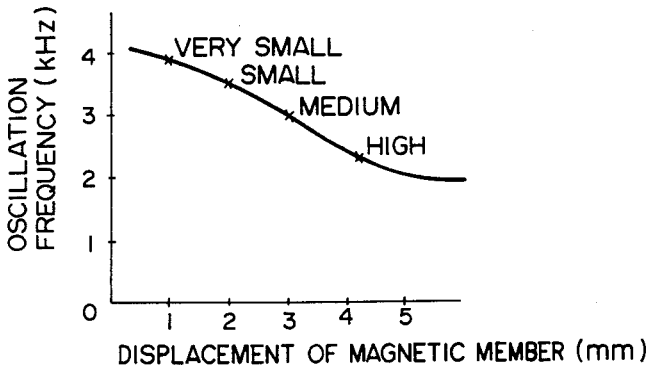
FIG. 17 is a graph illustrative of a characteristic curve of the output signal from the electric circuit shown in FIG. 16.

With this construction, the diaphragm 71 is displaced upwardly as the water level increases so that the magnetic member 73 approaches the coil 74, and, conversely, it is displaced downwardly to be restored to its original position as the pressure decreases. In other words, changes in the pressure cause the magnetic member 73 to be displaced relative to the coil 74. As a result, the coil 74 changes in reactance. Typically, an LC oscillator utilizing the changes in reactance is provided and oscillation frequencies of the LC oscillator are judged by the microcomputer to determine values of the water level. A fundamental circuit of the LC oscillator is shown in FIG. 16, having capacitors 80, adjusting resistors 81 and 84 and an inverter 83. Oscillation output signals are applied to the processing circuit 100*a*. If necessary, a counter/timer interface circuit may be inserted between the fundamental circuit and the processing circuit 100*a*. Experimentally, the oscillation frequency varies with the displacement of the magnetic member 73 so as to decrease as the reactance increases, thereby tracing a curve as shown in FIG. 17. A desired point on this curve is used for determination of a water level suitable for controlling.

Figure 22:
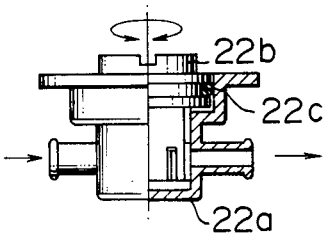
FIG. 22 is a partly sectional view of a liquid cleanser feed amount regulator shown in FIG. 4.
Figure 23:
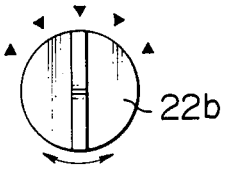
FIG. 23 is a front view of a regulating valve shown in FIG. 22.

The cleanser feed amount regulator 22*a* shown in FIG. 4 has the construction as exemplified in FIGS. 22 and 23. The regulating valve 22*b* is rotatably fitted in a body of the regulator 22*a*. A seal packing 22*c* prevents leakage of liquid, with a body of the regulator 22*a* having on either side a connection port to the tube 22. The regulating valve 22*b* permits a stepwise adjustment of flow rate of the cleanser in the path at five steps. For this adjustment, the regulating valve 22*b* may be turned, for example, a screw-driver, a coin or the like. The regulator is normally unlocked for the adjustment of flow rate, and the regulating valve 22*b* is adjusted in accordance with kinds the type of cleanser used. More particularly, the cleanser must be mixed with water at different ratios depending upon maker's specifications and/or types of cleanser. The amount of water supply is difficult to change because the level of water supplied to the washing drum 11 has been programmed in advance. Accordingly, to obtain a desired mixing ratio for a cleanser to be used, the regulating valve 22*b* is turned for adjustment of the cleanser feed amount. For a highly concentrated cleanser, the regulating valve 22*b* is set so as to suppress the flow rate. For a highly viscous cleanser, the regulating valve 22*b* is set so as to promote the flow rate. Maker names or cleanser names may be added to scale marks.

The regulator may be implemented in various forms. In one example, the input aperture area may be changed for regulation. To prevent spontaneous changes of the set position during operations, a suitable lock mechanism may preferably be added. The regulator is disposed downstream of the discharge port of the motor pump 25 to suppress variations in the cleanser feed amount.

As described previously, after an object to be washed is thrown in, the automatic washer is operated by keying in either main operation key to automatically effect water supply at a predetermined amount and then agitating. During this agitating, the cloth amount sensor 10 judges a cloth amount of the object being washed to thereby produce data which is processed by the microcomputer, and on the basis of the data, water supply is again effected for a washing operation. In synchronism with this water supply for washing operating, a cleanser feed amount, commensurate with the cloth amount, is metered. Around the end of the water supply for the washing operations, the cleanser feeder is actuated to feed the metered amount of cleanser while mixing the same with water supplied, and follow completion of the water supply, stirring or agitating for washing is commenced.

However, as graphically shown in FIG. 18, the viscosity of the liquid cleanser greatly changes with ambient temperatures to vary the transport amount by the motor pump 25 relative to drive times. For example, even when the drive time of motor pump 25 is set such that 40 ml cleanser is fed at 20° C. for a rated washing capacity, the cleanser feed amount changes to 13 ml at 0° C. and to 55 ml at 40° C., resulting in great differences in the cleanser feed amount.

Figure 21:
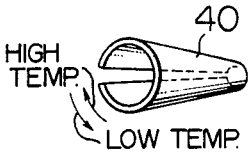
FIG. 21 is a perspective view of a bimetallic tube available for mechanically changing the size of a path for liquid cleanser.

Therefore, it is necessary to detect ambient temperatures by the temperature sensor 104 based on electronic measurement by, for example, a thermistor, in order to make corrections for changes in viscosity of the cleanser. One method for this purpose divides the ambient temperature range into fine segmental ranges and a drive time for motor pump 25 corresponding to each segmental range is adjusted so as to permit a desired cleanser feed amount. Thus, as shown in FIG. 19, a drive time a is used for a segmental ambient temperature range $T_1$, a drive time b for a segmental temperature range $T_2$ and so on. According to a second method, ambient temperature data from the temperature sensor 104 is converted by the microcomputer into an electrical quantity applied to the motor pump 25 and the electrical quantity (or driving electrical power) is so controlled so as to provide an electric power curve (FIG. 20) which is complementary, excessively if necessary, to the curve of FIG. 18. This second method can readily be implemented using a small DC motor. A third method employs a thermo-responsive element such as a bimetallic member which can mechanically change the liquid cleanser passage path to adjust the flow rate. Specifically, a conical bimetallic tube 40 as shown in FIG. 21 is inserted in the path. The bimetallic tube 40 is responsive to lower temperatures to deform outwardly, thereby establishing an enlarged passage and conversely responsive to higher temperatures to deform inwardly, thereby establishing a narrowed passage. A fourth method employs a heater 140 (FIG. 4) disposed at a lower portion of the tank 23. Electric powe supply to the heater is controlled in accordance with signals from the temperature sensor to suppress viscosity changes per se. This method is not recommendable because in spite of 40 ml of liquid cleanser being used per washing operation, 2,000 ml of liquid cleanser for about one month use is stored in the tank 23 and electric power consumption is unduly wasted to heat the entire storage amount.

Referring again to FIG. 8, display of operations will be described in greater detail. The display portion 52 includes indicators for water level, rinse, power supply and washing time which use light emitting diodes.

Display of water level is indicated from the highest level to the lowest level by four gradings of "high", "medium", "small" and "very small". As described previously, the display of water level corresponds to display of the cloth amount.

When either main operation key is turned on, the water supply is started in accordance with the simplified flow chart shown in FIG. 10. At the same time, the indicators for water level display are sequentially flashed from "high" toward "medium", "small" and "very small". This sequential flashing is repeated by sweeping all the indicators.

As the water level reaches the "very small" level, the water supply is stopped to allow the stirring or agitating for measurement of the cloth amount to proceed. Until completion of the cloth amount measurement, flashing indicative of "very small" continues. Thereafter, the water supply is again effected up to a water level corresponding to a cloth amount measured from the stirring process and this water level is displayed by flashing a corresponding indicator.

In this manner, process operations until the determination of the water level corresponding to the measured cloth amount are displayed by sweeping all the indicators for water level display, ensuring direct visual recognition of the water level determination process (cloth amount detection process). No additional indicators are required for water level display and compact display can advantageously be constituted.

The measurement of cloth amount is performed after the water supply reaches the "very small" level in the foregoing embodiment, but the cloth amount may alternatively be measured before or during the water supply. The cloth amount measurement during the water supply can shorten the time for the process preceding washing process. The cloth amount measurement in the absence of supplied water does not require the temporary stoppage of water supply to simplify water supply control correspondingly. A small amount of a relatively soft objects to be washed is suited for the cloth amount measurement without water.

Stirring or agitating during the water supply can sooner place a great amount of objects to be washed in soakage in water and the following cloth amount measurement can be started at an earlier time. Stirring or agitating after completion of the water supply until the "very small" level tends to greatly decrease the water level (particularly when the cloth amount is large), leading to inaccurate cloth amount measurement. Stirring or agitating during the water supply eliminates such inconveniences.

As described above, the fully-automated washer capable of optimum washing operations can be realized by measuring an accurate cloth amount of an object to be washed, determining such parameters as a water supply amount, a cleanser feed amount, a stirring or agitating time and a rinse time on the basis of a measured cloth amount, effecting fine control for accurate feed of a determined amount of water supply and a determined amount of cleanser, and employing an arrangement for the fine control.

We claim:

1. A fully-automated washer comprising:

a longitudinally arranged washing drum into which an object to be washed is thrown and which also serves as a dehydration drum;

a stirring blade rotatably provided on an inner bottom of said washing drum;

an electric motor for driving said stirring blade during washing and rinsing;

means for supplying water into said washing drum;

a water level sensor for detecting an amount of water supplied into said washing drum;

means for regulating a feed amount of a liquid cleanser and feeding the regulated amount of the liquid cleanser into said washing drum;

and a cloth amount sensor for measuring an amount of the cloth thrown into said washing drum, including eletromotive force generating means for generating an electromotive force associated with rotation of said electric motor, and a counter for determining either a number of pulses or a number of waveforms relative to the electromotive force while said electric motor inertially rotates in response to turning off of a power supply for the electric motor.

2. A fully-automated washer according to claim 1 wherein said water supply amount sensor is a water level sensor for detecting a water level within said washing drum corresponding to said water supply amount.

3. A fully-automated washer according to claim 2 wherein said electrical control means determines a water supply amount for stirring adapted for washing and a water supply amount for stirring adapted for rinsing, said water supply amount for rinse stirring being one grade higher than said water supply amount for wash stirring within a range not exceeding a maximum water level within said washing drum.

4. A fully-automated washer according to claim 3 wherein said electrical control means further determines a water supply amount for a second step of rinse stirring, said water supply amount for the second rinse stirring step being equal to the maximum water level within said washing drum.

5. A fully-automated washer according to claim 1 wherein said cloth amount sensor is coupled to said stirring means and detects a cloth amount of said object on the basis of a damping time for a motion of said stirring means when said stirring means is deenergized.

6. A fully-automated washer according to claim 5 wherein said stirring means comprises an electric motor, and said cloth amount sensor measures said damping time by counting peaks of an electromotive force waveform induced in said motor due to its inertial revolution when said motor is turned off.

7. A fully-automated washer according to claim 6 wherein an ON-state and an OFF-state of said motor are cyclically repeated plural times, and said cloth amount sensor measures said damping time by summing up the number of peaks of voltage waveforms induced during a plurality of OFF-states of said motor.

8. A fully-automated washer according to claim 6 wherein, in measuring said damping time by using said cloth amount sensor, the duty ratio of said motor is selected to become smaller than that at a normal washing state of said motor.

9. A fully-automated washer according to claim 6 wherein an ON-state and an OFF-state of said motor are cyclically repeated plural times and said cloth amount sensor measures said damping time by averaging the number of peaks of voltage waveforms induced during a plurality of OFF-states of said motor.

10. A fully-automated washer according to claim 1 wherein the cloth amount of said object is detected twice by said cloth amount sensor before and after feeding the cleanser.

11. A fully-automated washer according to claim 1 wherein when said electrical control means instructs said cleanser feed means to feed the cleanser, said water supply means is instructed by said electrical control means to supply water in synchronism with feed of the cleanser.

12. A fully-automated washer according to claim 1 further comprising a manually operable key for requesting feeding of the cleanser, wherein said electrical control means fetches a key-in input signal from said manually operable cleanser feed request key during wash stirring.

13. A fully-automated washer according to claim 1 further comprising a manually operable key for requesting feeding of the cleanser, wherein said electrical control means fetches a key-in input signal from said manually operable cleanser feed request key after completion of water supply by said water supply means.

14. A fully-automated washer according to claim 1 further comprising a mechanical member, disposed in a liquid cleanser transport path of said cleanser feed means, for changing a cross-sectional area of the transport path in accordance with ambient temperatures.

15. A fully-automated washer according to claim 1 wherein said cleanser feed means comprises a check valve, disposed it a cleanser discharge port of said cleanser feed means, for preventing the cleanser from dripping due to its weight or aliquid level difference.

16. A fully-automated washer according to claim 15 wherein said cleanser feed means includes cleanser pump means, and cleanser feed amount regulating means disposed in a cleanser path between said check valve and said pump means, said regulating means being capable of adjusting stepwise the cleanser flow rate in said cleanser path at a plurality of steps.

17. A fully-automated washer according to claim 1 wherein said water supply means includes a water supply valve controlled by said electrical control means and a water supply path for supplying water from said water supply valve to said washing drum, and said cleanser feed means has a cleanser discharge port disposed downstream of said water supply path.

18. A fully-automated washer according to claim 1 wherein said cleanser feed means comprises pump means having ability to discharge air.

19. A fully-automated washer according to claim 18 wherein said electrical control means controls the feed amount of the liquid cleanser by controlling the driving time for said pump means of said cleanser feed means.

20. A fully-automated washer according to claim 18 wherein said electrical control means controls the feed amount of the liquid cleanser by controlling the electric power supplied to said pump means of said cleanser feed means.

21. A fully-automated washer according to claim 18 wherein said feed means further includes: a storage tank for storing the liquid cleanser; a piping for transporting the cleanser from said storage tank to said washing drum; and a check valve disposed at a discharge port of said piping, whereby said cleanser is prevented from contacting air between said storage tank and said check valve.

22. A fully-automated washer comprising:

a washing drum into which an object to be washed is thrown;

a cloth amount sensor for measuring a cloth amount of said object including information regarding a degree of bulkiness of said object;

means for supplying water to said washing drum;

a sensor for detecting an amount of water supplied from said water supply means;

means for regulating a feed amount of a liquid cleanser and feeding a regulated amount of the liquid cleanser;

means for stirring said object within said washing drum; and electrical control means coupled to said cloth amount sensor, said water supply means, said water supply amount sensor, said cleanser feed means and said stirring means and being responsive to a measured cloth amount of said object from said cloth amount sensor to determine an amount of water to be supplied by said water supply means, an amount of the cleanser to be fed by said cleanser feed means and a stirring time by said stirring means, wherein said cleanser feed means comprises a storage tank for storing the liquid cleanser, said fully-automated washer further comprises a temperature sensor for detecting an ambient temperature near said storage tank, and said electrical control means is responsive to a detection output signal from said temperature sensor to correct the cleanser feed amount from said cleanser feed means in accordance with a temperature dependent change in viscosity of the cleanser.

23. A fully-automated washer according to claim 22 wherein said electrical control means is responsive to the detection output signal from said temperature sensor to control the driving time for said cleanser feed means.

24. A fully-automated washer according to claim 22 wherein said electrical control means is responsive to the detection output signal from said temperature sensor to control the driving electric power for said cleanser feed means.

25. A fully-automated washer according to claim 22 wherein said temperature sensor is an electronically measuring type sensor.

26. A fully-automated washer according to claim 22 wherein said temperature sensor is disposed beneath a top cover of said washer.

* * * * *

UNITED STATES PATENT AND TRADEMARK OFFICE

CERTIFICATE OF CORRECTION

PATENT NO. : 4,779,430

DATED : October 25, 1988

INVENTOR(S) : Thuruta, et al.

It is certified that error appears in the above-identified patent and that said Letters Patent is hereby corrected as shown below:

Title page:

On line [75] Inventors: please insert the following names:

Hiroshi Kinoshita, Hitachi
Kazufumi Ikeda, Hitachi
Yoshio Ohwa, Kitaibaraki
Toshiyuki Hori, Hitachi
Masayoshi Hirayama, Hitachi
Takeo Honma, Hitachi Signed and Sealed this Eighth Day of August, 1989

*Attest:*

*Attesting Officer*

DONALD J. QUIGG

*Commissioner of Patents and Trademarks*